US011255041B2

(12) United States Patent
Brisjö et al.

(10) Patent No.: US 11,255,041 B2
(45) Date of Patent: Feb. 22, 2022

(54) TUMBLE DRYER

(71) Applicant: Electrolux Professional AB (publ), Stockholm (SE)

(72) Inventors: Johan Brisjö, Stockholm (SE); Martin Nilsson, Stockholm (SE); Gunnar Ingemar Persson, Stockholm (SE)

(73) Assignee: Electrolux Professional AB (publ), Stockholm (SE)

( * ) Notice: Subject to any disclaimer, the term of this patent is extended or adjusted under 35 U.S.C. 154(b) by 73 days.

(21) Appl. No.: 16/636,201

(22) PCT Filed: Aug. 9, 2017

(86) PCT No.: PCT/EP2017/070165
§ 371 (c)(1),
(2) Date: Feb. 3, 2020

(87) PCT Pub. No.: WO2019/029800
PCT Pub. Date: Feb. 14, 2019

(65) Prior Publication Data

US 2020/0370234 A1 Nov. 26, 2020

(51) Int. Cl.
*D06F 58/20* (2006.01)
*D06F 103/36* (2020.01)
(Continued)

(52) U.S. Cl.
CPC ..... *D06F 58/206* (2013.01); *D06F 58/02* (2013.01); *D06F 2103/36* (2020.02); *D06F 2105/26* (2020.02)

(58) Field of Classification Search
CPC ..... D06F 58/206; D06F 58/30; D06F 58/02; D06F 2103/36; D06F 2105/26
(Continued)

(56) References Cited

U.S. PATENT DOCUMENTS 4,621,438 A 11/1986 Lanciaux
5,343,632 A * 9/1994 Dinh ..... F26B 21/14 34/507
(Continued)

FOREIGN PATENT DOCUMENTS

CN 1851333 10/2006
DE 4212700 A1 10/1993
(Continued)

OTHER PUBLICATIONS

International Search Report and Written Opinion issued in PCT/EP2017/070165 dated Oct. 17, 2017, 9 pages.
(Continued)

*Primary Examiner* — Stephen M Gravini
(74) *Attorney, Agent, or Firm* — Pearne & Gordon LLP

(57) ABSTRACT

The present disclosure relates to a tumble dryer (1) comprising a housing (2), a rotatable drum (11) in the housing being accessible from a front side (3) of the housing, and a fan arrangement (13) for producing a flow of process air through the drum. A heat pump is used for drying the process air before it enters the drum, the heat pump comprising a condenser (19), a compressor (17), and an evaporator (15). The condenser 19 the compressor (17), and the evaporator (15) are arranged as components in a heat pump unit (43), wherein the heat pump unit is removable from the remainder of the tumble dryer (1) through an opening in the rear side of the tumble dryer housing without separating the components. This facilitates for instance service of the tumble dryer.

15 Claims, 3 Drawing Sheets

(51) Int. Cl.
*D06F 105/26* (2020.01)
*D06F 58/02* (2006.01)

(58) Field of Classification Search
USPC ..... 34/73, 595–610
See application file for complete search history.

(56) References Cited

U.S. PATENT DOCUMENTS

| | | | | |
|---|---|---|---|---|
| 7,377,052 | B2 * | 5/2008 | Maruca | D06F 58/10 34/201 |
| 10,968,560 | B2 * | 4/2021 | Park | D06F 58/24 |
| 2004/0079121 | A1 * | 4/2004 | Yabuuchi | D06F 25/00 68/19.2 |
| 2005/0198852 | A1 | 9/2005 | Ono | |
| 2011/0277334 | A1 * | 11/2011 | Lee | D06F 58/206 34/73 |
| 2016/0083893 | A1 * | 3/2016 | Del Pos | D06F 58/24 34/595 |
| 2017/0191211 | A1 * | 7/2017 | Kim | D06F 39/12 |
| 2018/0251933 | A1 * | 9/2018 | Park | D06F 58/26 |
| 2020/0332457 | A1 * | 10/2020 | Civanelli | D06F 58/24 |
| 2020/0370234 | A1 * | 11/2020 | Brisjo | D06F 58/206 |
| 2021/0010195 | A1 * | 1/2021 | Brisjo | D06F 58/206 |
| 2021/0156072 | A1 * | 5/2021 | Won | D06F 58/24 |
| 2021/0164154 | A1 * | 6/2021 | Brisjo | D06F 58/206 |

FOREIGN PATENT DOCUMENTS

| | | | | |
|---|---|---|---|---|
| DE | 102009046786 | | 6/2010 | |
| EP | 1411163 | A2 | 4/2004 | |
| EP | 2799612 | A1 | 11/2014 | |
| EP | 2896740 | A1 | 7/2015 | |
| EP | 2987904 | A1 | 2/2016 | |
| EP | 3118365 | A1 | 1/2017 | |
| EP | 3252218 | A1 * | 12/2017 | D06F 29/005 |
| EP | 3392393 | B1 * | 4/2020 | D06F 34/28 |
| JP | S5574585 | | 5/1980 | |
| JP | 2005253589 | | 9/2005 | |
| JP | 2005265402 | | 9/2005 | |
| JP | 2006150095 | | 6/2006 | |
| JP | 2006230887 | A | 9/2006 | |
| JP | 2007135958 | | 6/2007 | |
| WO | WO-2017119585 | A1 * | 7/2017 | D06F 25/00 |
| WO | WO-2019029800 | A1 * | 2/2019 | D06F 58/20 |

OTHER PUBLICATIONS

US Office action for U.S. Appl. No. 16/636,203 dated Sep. 7, 2021, 22 pages.

Translation of Japanese Office action for application No. JP 2020-529809 dated Oct. 26, 2021, 6 pages.

* cited by examiner

Fig 5
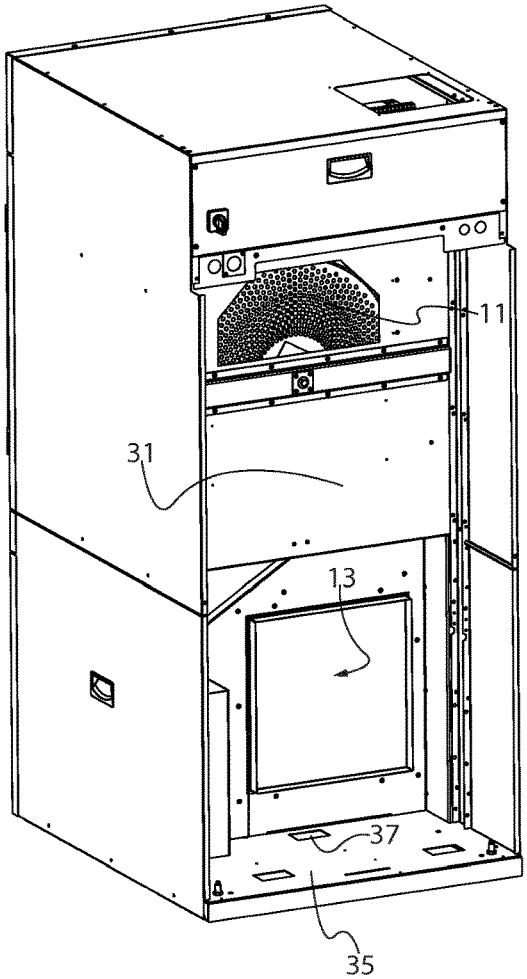
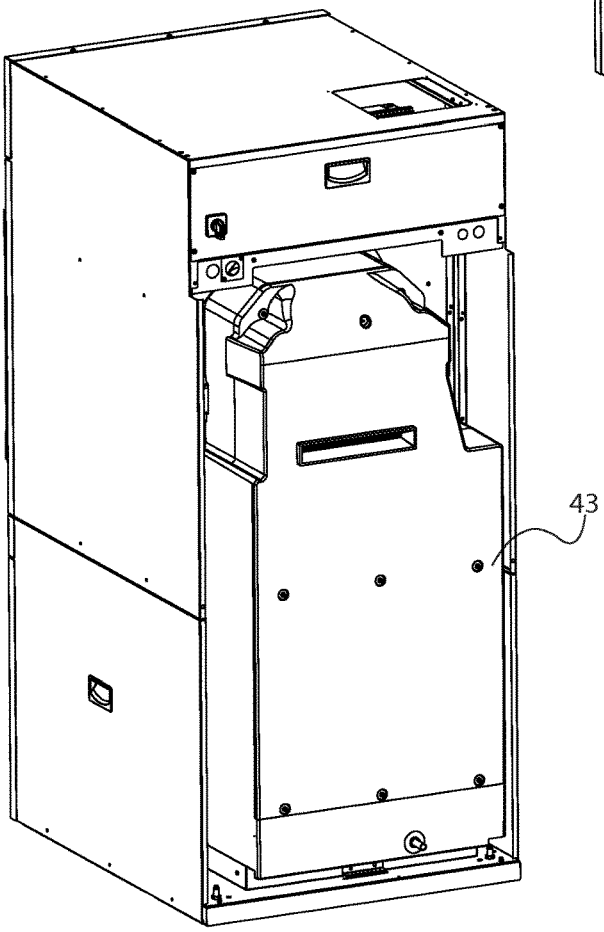
Fig 6
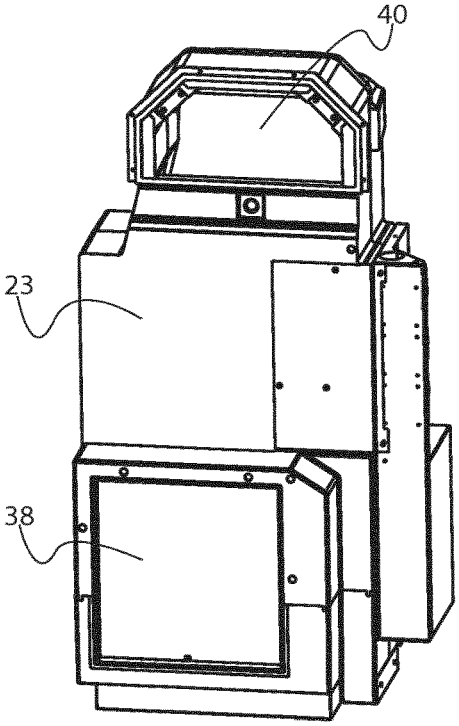
Fig 7

TUMBLE DRYER

FIELD OF THE INVENTION

The present disclosure relates to a tumble dryer comprising a housing, a rotatable drum in the housing being accessible from a front side of the housing, a fan arrangement for producing a flow of process air through the drum, and a heat pump for drying the process air before entering the drum, wherein the heat pump comprises a condenser, a compressor, and an evaporator.

TECHNICAL BACKGROUND

Such a tumble dryer is shown for instance in EP-3118365-A1, describing a tumble dryer with a heat pump. One problem associated with such tumble dryers is how to accomplish efficient maintenance procedures during use of the tumble dryer.

SUMMARY OF THE INVENTION

One object of the present disclosure is therefore to provide a tumble dryer on which repairs and maintenance can be carried out in an efficient way. This object is achieved by means of a tumble dryer as defined in claim 1. More specifically, in a tumble dryer of the initially mentioned kind, the condenser, the compressor, and the evaporator are arranged as components in a heat pump unit, which is removable from the remainder of the tumble dryer through an opening in the rear side of the housing without separating the components thereof from each other. The heat pump unit may comprise a complete closed refrigerant loop and further include an expansion valve.

With such a configuration, the entire heat pump arrangement can be easily replaced and a heat pump in need of maintenance can be dealt with at a central workshop location rather than attempting e.g. to fill the heat pump in the field. Further, the tumble dryer can quickly return to full operation with a replaced heat pump unit.

The condenser the compressor, the evaporator and the expansion valve may be enclosed in a common insulating shell which provides for improved energy efficiency. Such a shell may be made e.g. from expanded polypropylene, EPP, and may comprise an air inlet and an air outlet. The shell may further comprise a drain tube for leading water out from the shell.

The heat pump unit may comprise a common frame, and the condenser, the compressor, and the evaporator may be attached to the common frame.

The condenser may be located above the compressor, and the evaporator may be located in front of the compressor as seen from the tumbler dryer front side. This gives efficient use of the available space in the tumble dryer housing.

The condenser may be supported by a top frame of the common frame, supporting the condenser at the edges of the condenser bottom surface, such that process air may pass through said bottom surface at inner parts thereof.

The evaporator may extend into a space under the rotatable tumble dryer drum.

The heat pump unit may be provided with wheels, such that it can be rolled on a floor. This simplifies moving the heat pump unit during repair procedures. The opening of the housing may have an inner floor which is provided with slots into which the wheels may extend when the heat pump unit is installed in the tumble dryer. This makes sure that the heat pump unit rests in a stable manner on the inner floor when installed.

BRIEF DESCRIPTION OF THE DRAWINGS

FIG. 5-6 show the rear side of a tumble dryer before and after installing a heat pump unit.

FIG. 7 shows a perspective view of a heat pump shell as seen from the front thereof.

DETAILED DESCRIPTION

Figure 1:
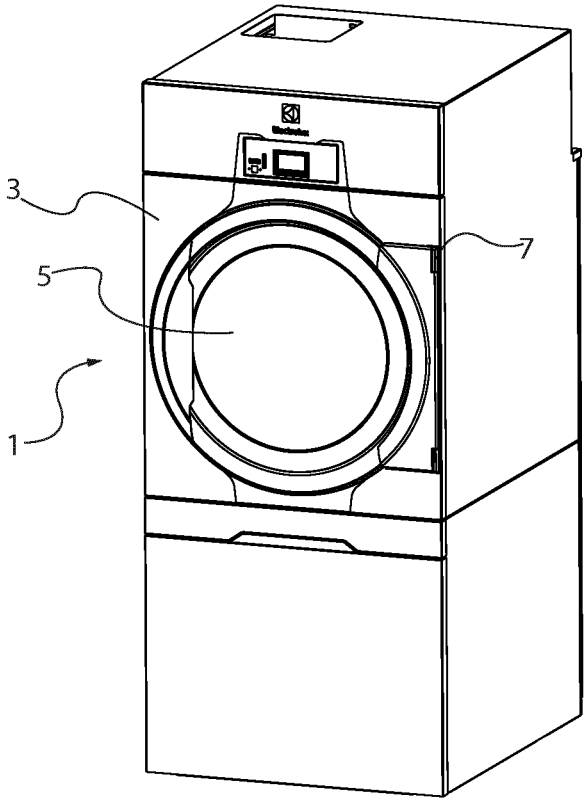
FIG. 1 shows a perspective view of a tumble dryer.

The present disclosure relates generally to a tumble dryer provided with heat pump in order to achieve energy-efficient drying of laundry. An example of a tumble dryer 1 is illustrated in FIG. 1. The tumble dryer 1 has a front side 3 which is provided with a door or hatch, attached to the front side 3 with hinges 7, which provides access to a tumble dryer drum behind the door 5 where wet laundry can be loaded.

Figure 2:
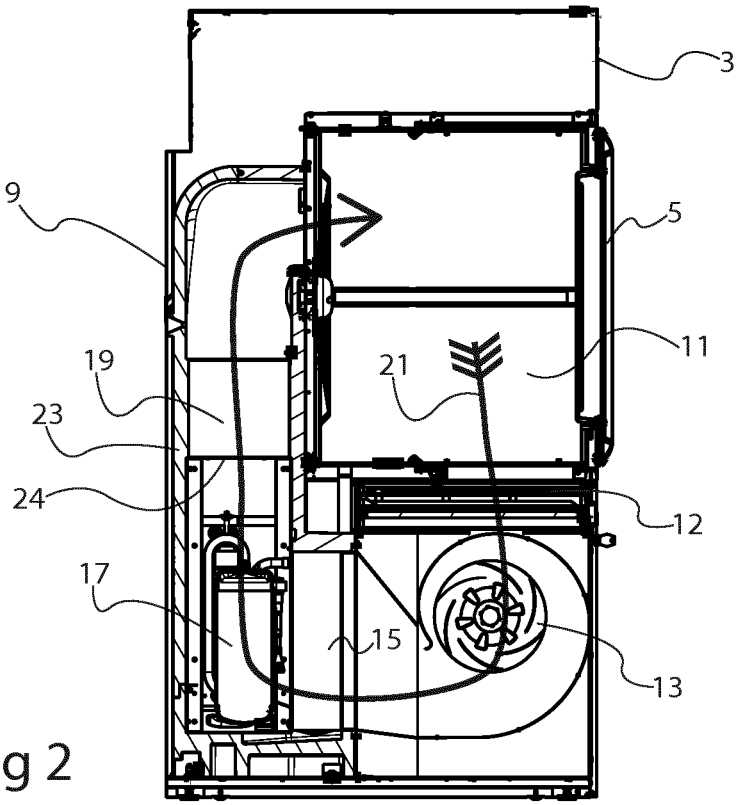
FIG. 2 illustrates schematically the flow of process air through a heat pump tumble dryer according to the present disclosure.

In a heat pump tumble dryer, process air drying the laundry can circulate within the outer enclosure of the tumble dryer. FIG. 2 illustrates, schematically and in a cross section, components of such a tumble dryer as well as a process air path 21. As mentioned, the tumble dryer comprises a drum 11 in which wet laundry is placed. While the drum 11 rotates, a flow of relatively dry process air is fed therethrough. The flow is provided by a fan 13 or blower, which in the illustrated case is located in a space under the drum 11.

Figure 3:
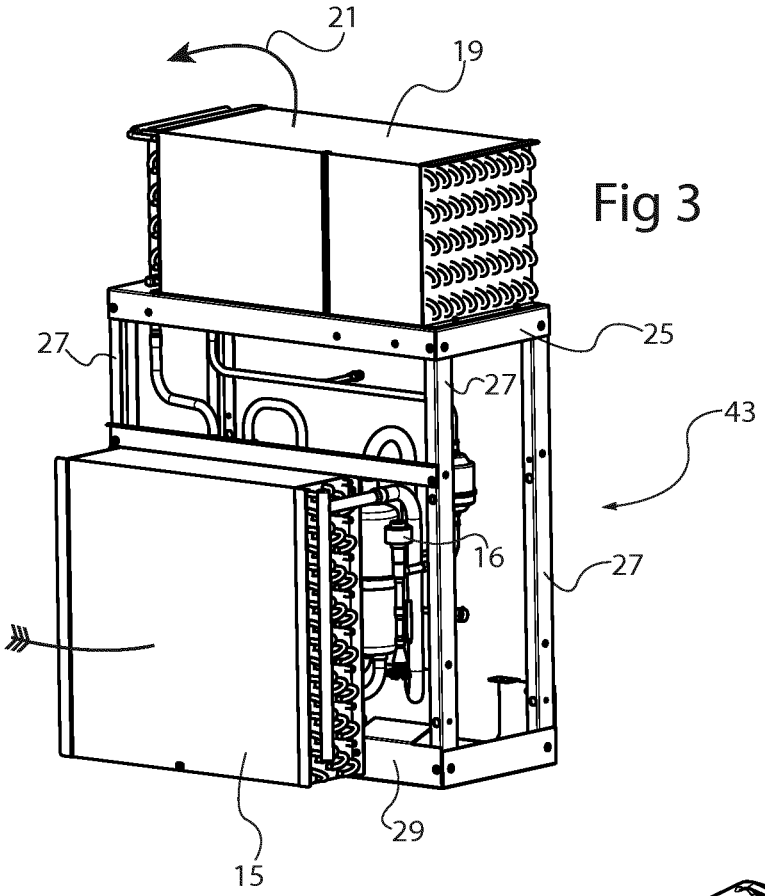
FIG. 3 shows a perspective view of a heat pump unit.

The tumble dryer includes a heat pump arrangement with an evaporator 15, a compressor 17, a condenser 19, and an expansion valve 16 (cf. FIG. 3). A refrigerant medium is forced through the heat pump arrangement by the compressor 17, and gathers energy in the evaporator 15 which is released in the condenser 19, as is well known per se.

As illustrated in FIG. 2, an air flow 21 is achieved, where hot, humid air is extracted from the drum 11, which is perforated, by means of the fan 13. The air flow first passing a filter 12 and the fan 13 then passes the evaporator 15, which cools the air flow such that moisture therein condenses into liquid water. This water is collected in the bottom section of the tumble dryer and is drained therefrom through a tube 39 (cf. FIG. 4).

The air flow which is now cooler and contains less water is passed to the rear section of the tumble dryer and subsequently passes the condenser 19, which heats the air again. Then, the heated, dry air is reintroduced into the drum 11 where it is again capable of absorbing water from the laundry therein.

The present disclosure relates to a tumble dryer where maintenance and service has been made easier. This is achieved as illustrated in FIG. 3 by providing the condenser 19 the compressor 17, and the evaporator 15 as components in a heat pump unit 43. The heat pump unit is removable from the remainder of the tumble dryer through an opening 31 (cf. FIG. 5) in the rear side of the tumble dryer housing without separating these components.

As shown in FIG. 2 and in the perspective view of FIG. 3, an example of such a configuration can be obtained where the condenser 19 is located behind the drum 11 as seen from the front side 3 of the tumble dryer, and above the compressor 17. As shown in the perspective view of a heat pump unit in FIG. 3, the evaporator 15 can extend horizontally from the compressor 17, and can as shown in FIG. 2 be located in front of the compressor 17 as seen from the housing front side 3. The evaporator 15 may then partly reach into the space under the rotatable drum 11, and may connect to the fan arrangement 13 to receive a flow of process air therefrom.

As shown in FIG. 3, there may be provided a framework 25, 27, 29 to which the compressor 17, the evaporator 15 and the condenser 19 are attached, such that there is formed a heat pump unit 43 which may be mounted as a whole unit in a tumble dryer. The heat pump unit may thus comprise a complete closed refrigerant loop, and also include an expansion valve 16.

The condenser 19 is carried by a support arrangement 25, 27 of this framework. The support arrangement may comprise a top frame 25 on which the condenser 19 rests and is attached. This top frame 25 may be rectangular to carry the condenser 19 at the outer edges of the condenser bottom surface, but may provide a large opening at the inner parts of this bottom surface to allow process air to flow through the condenser to be heated. The top frame 25 may be carried by a plurality of legs 27, in the illustrated case four legs 27, each located at a corner of the top frame 25. The compressor 17 may be located in between the legs 27, and the legs may be attached to a bottom frame 29. The condenser 19 is supported by the top frame 25 at the edges of the condenser bottom surface, such that process air may pass through this bottom surface 24 at inner parts thereof, as shown in FIG. 2.

An additional advantage with this configuration is that the compressor 17 is located in the flow of process air 21, between the evaporator 15 and the condenser 19. This means that heat dissipated from the compressor, which heat would otherwise become more or less wasted, is used to pre-heat the flow of process air 21 before it reaches the condenser 19. At the same time, the compressor 17 becomes cooled by the process air flow 21, which to a great extent renders unnecessary other cooling arrangement, used to avoid overheating of the compressor 17. This allows for a more energy efficient tumble dryer 1, that can be produced at a lower cost.

The framework of FIG. 3 may be produced as sheet metal parts, using materials such as aluminum or steel, for instance, although a plastic or composite framework could also be considered. Other framework configurations are possible. In order to allow the heat pump to be provided as a unit that can be installed or removed as a whole, it is preferred to provide a framework which takes up the load of the condenser 19 on either or both sides of the compressor 17 as seen from the housing front side 3, rather than for instance letting the condenser be suspended from an inner wall in the tumble dryer.

It is advantageous to keep the heat pump as a unit where the evaporator 15, the compressor 17 and the condenser 19 are included as components together with an expansion valve, and where the unit may be removed from or mounted in the tumble dryer without separating the components from each other. The closed refrigerant medium loop in the heat pump is preferably filled and sealed in a central location, before being assembled in the tumble dryer. This also makes it simpler to replace a heat pump in an existing tumble dryer in the field. It is even possible to replace e.g. a gas heating unit in an existing tumble dryer with a heat pump.

Figure 4:
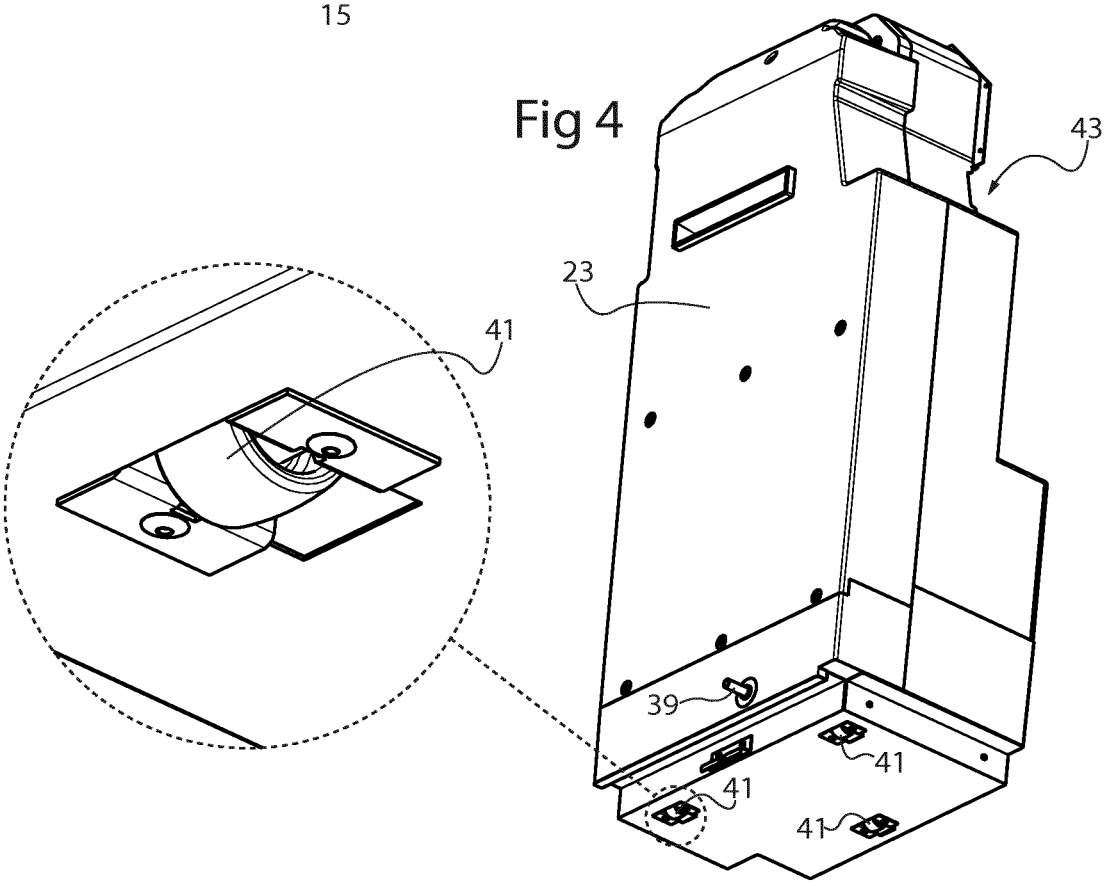
FIG. 4 shows a perspective view of the heat pump unit, provided with a shell and seen from below.

The provision of the heat pump as a complete unit also makes it possible to enclose the heat pump as a whole in an insulating shell 23 as shown in FIG. 4 as well as in the cross section of FIG. 2. Such a shell 23 may enclose the heat pump arrangement as a whole, but provide openings 38, 40 (cf. FIG. 7), matching with the fan arrangement and a connection to the rotating drum. The shell may be assembled from multiple parts and may be made in a suitable insulating material such as expanded polypropylene, EPP. The insulating shell improves the energy efficiency of the tumble dryer even further.

As illustrated in FIG. 4, the pump unit together with the insulating shell 23 may be provided with wheels 41 that facilitate moving the heat pump unit on a floor, for instance when replacing a heat pump unit in the field. Such wheels may be located in a bottom plate on which the heat pump unit with the insulating shell rests.

FIG. 5-6 show the rear side of a tumble dryer before and after installing a heat pump unit. As illustrated in FIG. 5, the rear side of the tumble dryer may reveal an opening 31 or recess by taking away a back wall (not shown). The opening has a sufficient space to enclose the heat pump unit, and once fitted therein, the back wall may be attached to the tumble dryer.

As shown in FIG. 5, there is provided openings to the rotatable drum 11 and to the fan arrangement 13 that fit with the openings in the heat pump shell 23. There may further be provided slots 37 in the floor 35 of the rear opening 31 into which any wheels of the heat pump unit can project once the heat pump unit is in place, such that the heat pump unit rests firmly on the rear opening floor 35.

FIG. 6 shows the same perspective view as FIG. 6 when the heat pump unit is mounted into the rear opening. This can be done simply by rolling the heat pump unit in place in the rear opening 31, attaching some connection points of the heat pump to the tumble dryer for instance by means of screws, and connecting the heat pump to the electric system of the tumble dryer.

FIG. 7 shows a perspective view of a heat pump shell 23 as seen from the front thereof, i.e. the side which connects to the tumble dryer drum 11. The drawing shows the openings 38, 40 in the bottom, air inlet (38), and upper parts, air outlet (40), connecting to the fan arrangement and to the drum, respectively. In addition to those openings, the shell may comprise electric wiring leading in and out of the shell as well as the aforementioned drain tube leading water out of the shell.

The present disclosure is not restricted to the above described examples, and may be varied and altered in different ways within the scope of the appended claims.

The invention claimed is:

1. Tumble dryer comprising:

a housing having an opening in a rear side, a rotatable drum arranged in the housing being accessible from a front side of the housing, a fan arrangement for producing a flow of process air through the drum, and a heat pump for drying the process air before entering the drum, the heat pump comprising:

a condenser, a compressor, and an evaporator all arranged as components in a heat pump unit, wherein the heat pump unit is removable from a remainder of the tumble dryer through the opening in the rear side of the housing without separating said components.

2. Tumble dryer according to claim 1, wherein the heat pump unit comprises a complete closed refrigerant loop.

3. Tumble dryer according to claim 2, wherein the closed refrigerant loop includes the condenser, the compressor, the evaporator, and an expansion valve.

4. Tumble dryer according to claim 3, wherein the condenser the compressor, the evaporator and the expansion valve are enclosed in a common insulating shell.

5. Tumble dryer according to claim 4, wherein the shell comprises expanded polypropylene, EPP.

6. Tumble dryer according to claim 5, wherein the shell comprises an air inlet and an air outlet.

7. Tumble dryer according to claim 5, wherein the shell comprises a drain tube for leading water out from the shell.

8. Tumble dryer according to claim 1, wherein the heat pump unit comprises a common frame.

9. Tumble dryer according to claim 8, wherein the condenser the compressor, and the evaporator are attached to the common frame.

10. Tumble dryer according to claim 9, wherein the condenser is located above the compressor, and the evaporator is located in front of the compressor as seen from a front side of said housing.

11. Tumble dryer according to claim 10, wherein the condenser is supported by a top frame of the common frame, the top frame supporting the condenser at edges of a bottom surface of the condenser, such that process air may pass through said bottom surface at inner parts thereof.

12. Tumble dryer according to claim 10, wherein the evaporator extends into a space under the rotatable drum.

13. Tumble dryer according to claim 1, wherein the heat pump unit is provided with wheels, such that the heat pump unit can be rolled on a floor.

14. Tumble dryer according to claim 13, wherein the opening in the rear side of said housing has an inner floor provided with slots into which the wheels may extend when the heat pump unit is installed in the tumble dryer.

15. Tumble dryer comprising:

a housing, a rotatable drum arranged in the housing and being accessible from a front side of the housing, a fan for producing a flow of process air through the drum, and a heat pump for drying the process air before entering the drum, the heat pump comprising:

a common frame, a condenser, a compressor, and an evaporator, wherein the condenser, the compressor and the evaporator are arranged as components in a heat pump unit and attached to the common frame, wherein the condenser is located above the compressor, and wherein the heat pump unit is removable from a remainder of the tumble dryer through an opening in a rear side of the housing without separating said components.

* * * * *